United States Patent [19]

Lomnicki

[11] 4,266,584

[45] May 12, 1981

[54] EDGER SAW COMBINING CHIPPER WITH CIRCULAR SAW BLADE

[75] Inventor: Joseph J. Lomnicki, Portland, Oreg.

[73] Assignee: Mainland Industries, Inc., Lake Oswego, Oreg.

[21] Appl. No.: 52,599

[22] Filed: Jun. 27, 1979

[51] Int. Cl.[3] ..... B27C 9/00

[52] U.S. Cl. ..... 144/39; 144/220; 144/223; 144/235

[58] Field of Search ..... 144/220, 223, 222, 118, 144/117 R, 117 A, 39, 162 R, 235

[56] References Cited

U.S. PATENT DOCUMENTS

| | | | |
|---|---|---|---|
| 692,583 | 2/1902 | Zimmermann | 144/235 X |
| 3,780,778 | 12/1973 | Chapman | 144/223 X |
| 3,880,215 | 4/1975 | Mallery | 144/220 X |
| 4,147,193 | 4/1979 | Kivimar | 144/220 X |

*Primary Examiner*—Willie G. Abercrombie

*Attorney, Agent, or Firm*—Chernoff & Vilhauer

[57] ABSTRACT

Apparatus for shaping a flat surface on a workpiece includes a rotary chipper head having a plurality of radially oriented chipper knives having facing edges and chipping edges, and a circular saw blade having a diameter greater than that of the end of the chipper head closest to the workpiece. The circular saw blade is attached to the hub of the chipper head and apertures are defined in the circular saw blade to receive the ends of the knives of the chipper head, so that the chipper knives extend into the apertures in the circular saw blade. The surface formed on the workpiece is that cut by the teeth of the circular saw, and material cut from the workpiece by the saw blade is cut into chips by the chipper knives. The saw blade is thus allowed some freedom of movement relative to each chipper blade, and the facing edges of the chipper blades rotate within the kerf of the circular saw blade. The teeth of the circular saw blade extend radially far enough beyond the chipper knives so that knots in wood such as pine are cut completely by the circular saw and are not torn from the workpiece by the chipper knives.

11 Claims, 7 Drawing Figures

FIG. 5
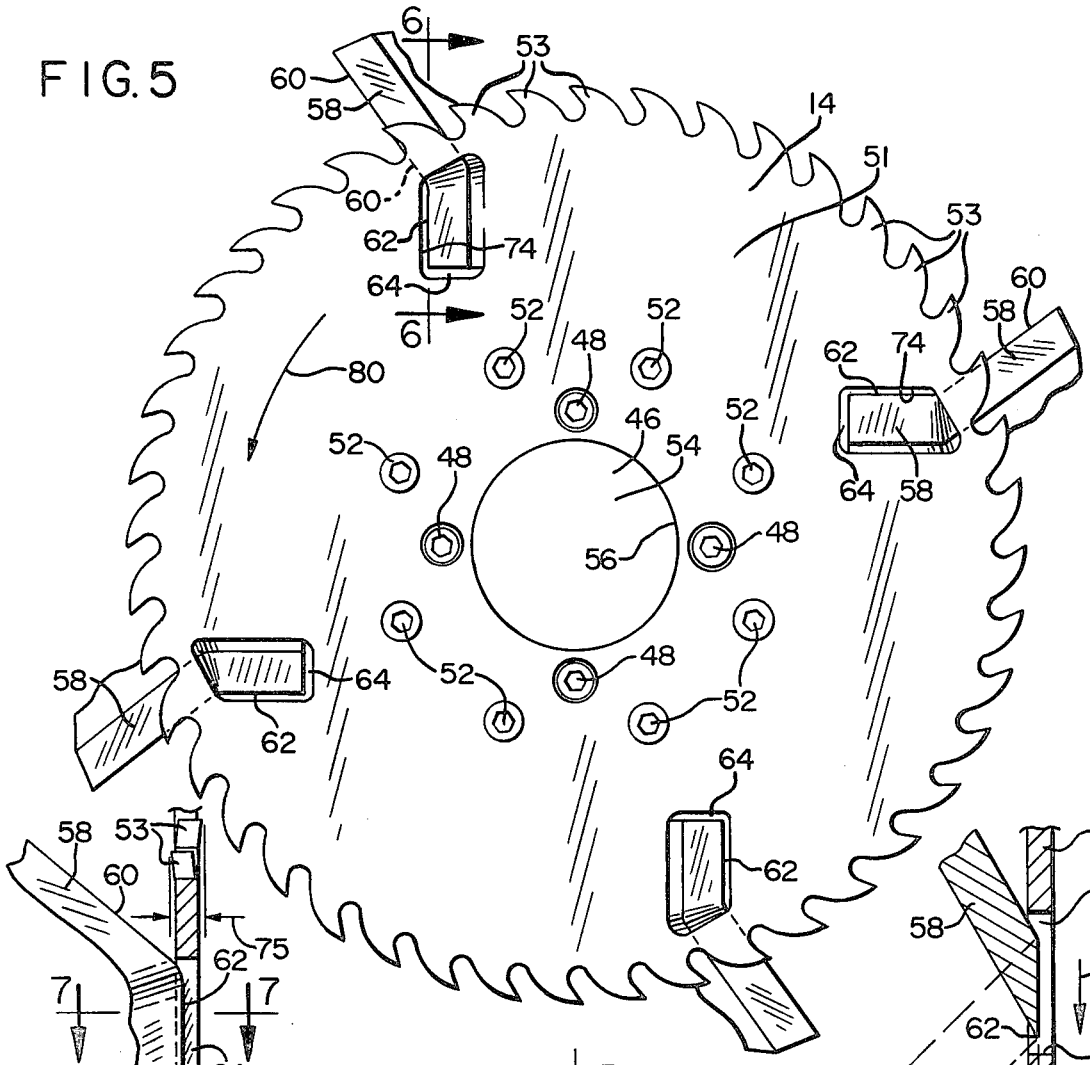
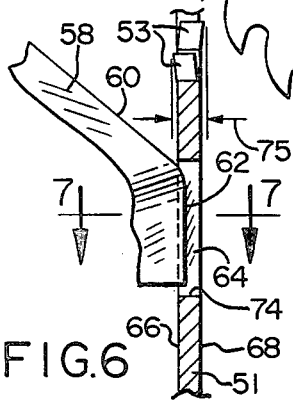
FIG. 6
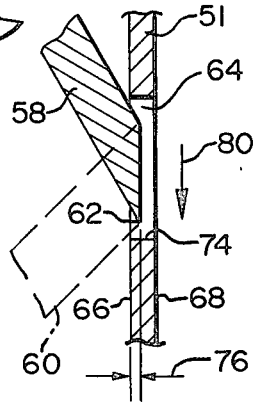
FIG. 7
FIG. 4
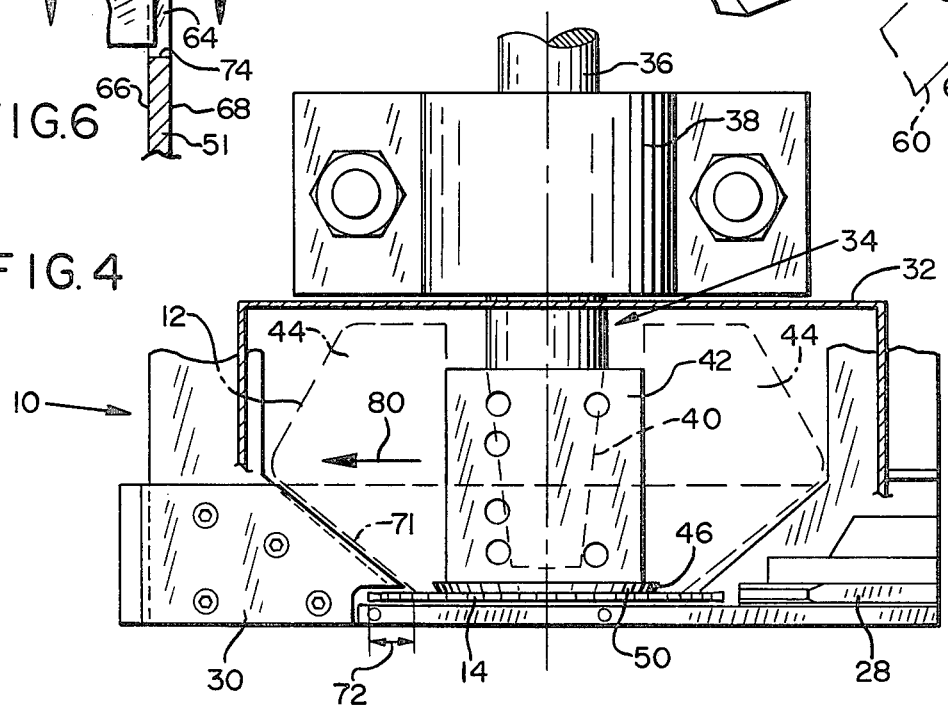

EDGER SAW COMBINING CHIPPER WITH CIRCULAR SAW BLADE

BACKGROUND OF THE INVENTION

The present invention relates to apparatus for forming flat surfaces on workpieces such as logs and cants of wood, and in particular to apparatus for simultaneously forming a sawn flat surface and chipping the material removed from the workpiece.

It is frequently desirable, because of the ease of disposal of chips as compared with irregular slabs of wood and bark, to cut the irregularly shaped waste material into chips when shaping a surface on a side of a log or edging a cant of wood. Log slabbing chippers are known in which a rotary chipper head has bent chipper knives having sharpened facing edge portions and sharpened chip cutting edge portions. In such a rotary chipper head the facing edge portions rotate in a plane which forms the finished surface of the workpiece, and the chipping edge portions of the chipper knives cut material removed from the workpiece into chips which may be used as pulp chips or raw material for pressed wood, chipboard and the like.

Maintenance of such chipper heads requires frequent sharpening of the chipper knives, and particularly the facing edge portions thereof, in order to consistently produce smooth flat surfaces. After sharpening, precise alignment of the facing edge portions of the chipper knives is required to provide a smooth flat surface. This alignment is time-consuming, yet it must be accomplished after each sharpening of the chipper knives.

Because a chipper takes bigger pieces of material from a workpiece than do the more numerous and smaller teeth of a saw, chipper knives are likely to break knots or crooked grained pieces from the surface of a workpiece rather than cut through them. Vibration of the last shaped end of the workpiece results in additional work which must be rejected because of surface irregularities. It has been found that because of these problems a smoother lumber finish may be produced if the workpiece surface is formed by first sawing the workpiece and thereafter chipping the scrap material. Apparatus for carrying out the operations of first sawing a flat surface and then chipping the scrap in one process has been disclosed in Chapman Canadian Pat. No. 940,016, and Mallery U.S. Pat. No. 3,880,215.

The Chapman patent discloses a chipper head having saw toothed segments mounted between the ends of the chipper knives such that the teeth of each segment extent radially beyond the edges of the chipper knives, at the end of the chipper head which contacts the workpiece. The ends of the chipper knives thus rotate within the kerf cut in the workpiece by the saw teeth.

While the Chapman apparatus provides a smoother surface than a chipper head alone, this manner of combining saw action and chipper head action is unnecessarily complex. Each saw toothed segment in the Chapman apparatus must be individually sharpened, set, and aligned in order to provide a smooth surface on the workpiece. The resulting gaps between the segments require the segments to be mounted eccentrically with respect to the axis of rotation of the chipper head in order to avoid uneven wear of the saw teeth. Separate segments also limit the distance by which the saw teeth can extend beyond the chipper head without very large gaps between teeth.

Mallery discloses a circular saw blade simply bolted to the end of a rotary chipper head, with the end of each chipper knife edge abutting against the saw blade. The saw blade is of greater diameter than the circular path or rotation of the abutting ends of the chipper knives, so that the saw blade cuts the workpiece ahead of the chipper. Since the chipper knives abut against the saw blade, however, the distance by which the radius of the saw blade can exceed the radius of the circle of rotation of the chipper knives is limited. With too great a saw blade radius slivers may wedge between the circular saw blade and the ends of the chipper knives, throwing the saw blade out of alignment. Such jamming of wood slivers may result in damage to the saw blade, and also produces unevenness of the surface of the workpiece. Any lateral movement between the saw blade and the chipper knives also results in noisy and potentially harmful hammering of the saw blade and chipper knives against one another.

What is needed, therefore, is an apparatus which does not require extensive or frequent maintenance and is capable of providing a smoothly sawn surface and chipping waste material in one operation. It is also desired to have such an apparatus which is simple to assemble and align and which is not adversely affected by slivers trimmed from a workpiece.

SUMMARY OF THE INVENTION

The above-mentioned shortcomings and disadvantages of the previously known saw and chipper combinations are overcome by the present invention, which provides a circular saw combined with a chipper head, wherein the ends of the chipper knives extend into apertures within the plate of the circular saw blade.

In the apparatus of the present invention a face plate is attached to the end of the hub of a chipper head, providing a point of attachment and means of alignment of a circular saw blade perpendicular to and concentric with the mandrel on which the chipper head is mounted. The adaptor faceplate is of an appropriate thickness to space the circular saw blade away from the hub of the chipper head such that the ends of the chipper knives, including their entire facing edge portions, are within apertures defined in the saw plate. As a result, the ends of the chipper knives travel within the kerf cut by the saw blade. Because the chipper knives are within the apertures in the saw plate, there is no need for interruption of the regular spacing, or pitch, of saw teeth on the saw blade, and the teeth may be as closely spaced as desired, without gaps to allow for chipper knives. The saw blade may be maintained in the same manner as an ordinary circular saw, and requires no special alignment of separate segments.

The aperture provided to receive the end of each chipper knife is large enough to provide a small clearance around the facing edge portion and end of the chipping edge portion of the chipper knife, yet is not excessively large. The aperture thus provided does not excessively weaken the saw plate nor allow so much room that slivers become jammed between the chipper knife and the interior of the aperture.

Because there is no direct contact between the chipper knives and the saw plate, the saw plate may extend to a significant distance beyond the circle of rotation of the chipper knives. Slight flexing of the saw blade relative to the chipper knives does not cause damaging contact between the saw blade and the chipper knives, and the saw blade may be made large enough to saw completely through knots and split or crooked grained portions of the workpiece, so that the chipper knives do not tear out knots and crooked grain portions from the surface of the workpiece. As a result the surface produced on the workpiece has fewer imperfections than are produced by previously known apparatus.

Since the surface of the workpiece is created by the saw teeth, rather than the chipper knives, less vibration of the workpiece is caused, and the apparatus of the invention can provide a smooth surface nearer to the trailing end of a board or cant than was possible using a chipper head alone. The combined saw and chipper of the present invention thus provides considerable reduction of unacceptable workpiece surfaces in comparison to previously known devices.

Since the facing edges of the chipper knives are protected and turn within the kerf of the circular saw blade, the chipper knives require sharpening much less frequently. The reduced frequency of maintenance required also reduces the labor costs per unit of workpiece surfaces shaped, so that the apparatus of the present invention provides considerable economies of production.

It is therefore a primary objective of the present invention to provide improved apparatus for surfacing logs and cants and the like by use of a circular saw combined with a rotary chipper head.

It is another objective of the present invention to provide such surfacing apparatus which is of simplified construction which does not require extensive or frequent maintenance.

It is a feature of the invention that it permits use of a unitary circular saw blade, thus facilitating alignment of the apparatus to produce a smooth flat surface on a workpiece.

It is a feature of the saw blade of the invention that it can be adapted to be used on existing rotary chipper heads.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 4 is a top view of the saw and chipper head combination of the present invention, taken along line 4—4 of FIG. 2.

FIG. 5 is a detail view of a circular saw blade and chipper knife combination embodying the present invention, at a larger scale.

FIG. 6 is a fragmentary sectional view, at a yet larger scale, of the circular saw blade and chipper combination of the present invention, taken along line 6—6 of FIG. 5.

FIG. 7 is a fragmentary sectional view of the chipping knife and circular saw blade embodying the present invention, taken along line 7—7 of FIG. 6.

DETAILED DESCRIPTION OF THE INVENTION

Figure 1:
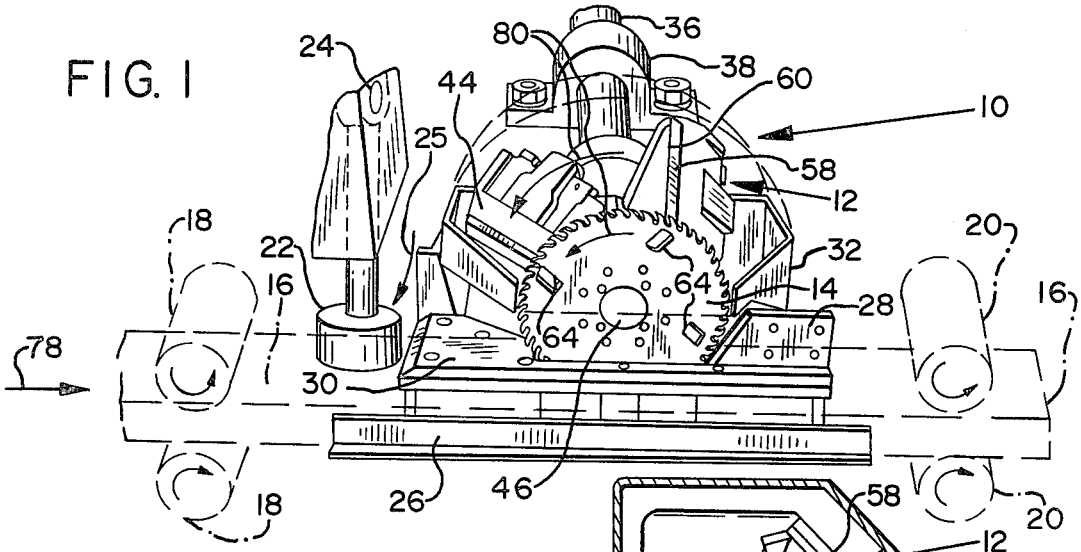
FIG. 1 is a pictorial front view taken from slightly above a circular saw and rotary chipper head combination embodying the present invention.

Referring now to FIG. 1 of the drawings, a preferred embodiment of the invention is included in surfacing apparatus 10 combining a chipper head 12 with a unitary circular saw blade 14. In the embodiment shown, a workpiece such as a cant 16 is fed into the surfacing apparatus 10 by infeed rollers 18 and outfeed rollers 20. A side roller 22 is mounted upon a pivot joint 24 so as to provide lateral pressure against the cant 16 to hold the cant 16 against a guide rail 26, allowing cants having varying width to be fed into the surfacing apparatus 10. An outboard guide shoe 28 located on the outfeed side of the circular saw blade 14 is aligned with the surface formed by the apparatus 10 and helps to hold the cant 16 against the guide rail 26. An anvil 30 located on the infeed side of the surfacing apparatus 10 supports the cant 16 adjacent to the chipper head 12 and the circular saw blade 14. Protective shielding 32, shown partially in broken line, contains chipped material as it is cut away from the cant 16, and suitable apparatus is provided (but not shown) for removing chips from the vicinity of the chipping head 12.

Figure 3:
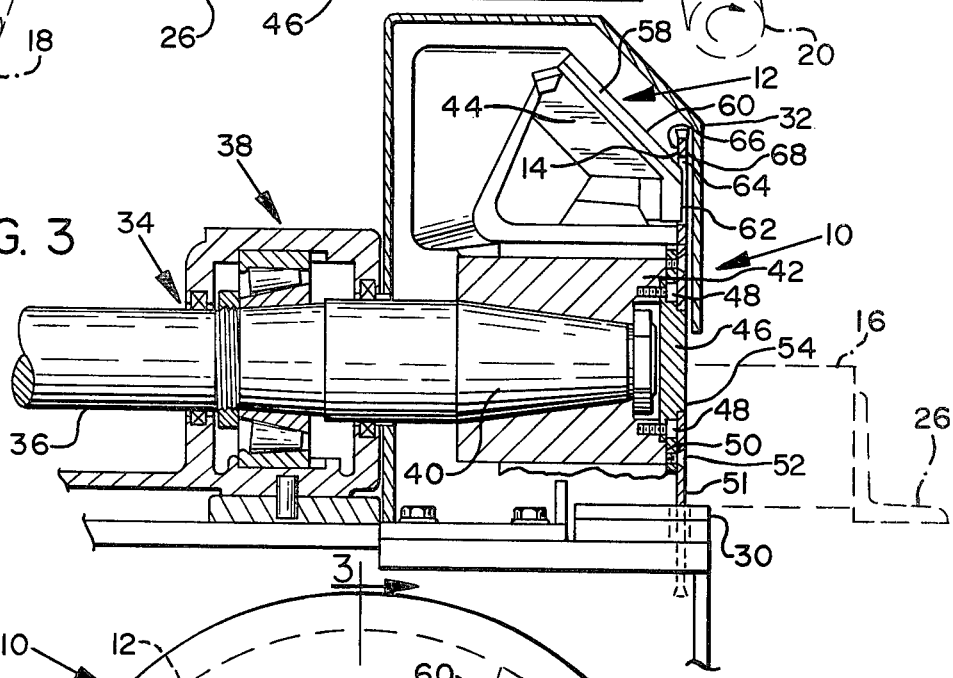
FIG. 3 is a sectional, partially cut-away view of the saw and chipper head combination of the present invention, taken along line 3—3 of FIG. 2.
Figure 2:
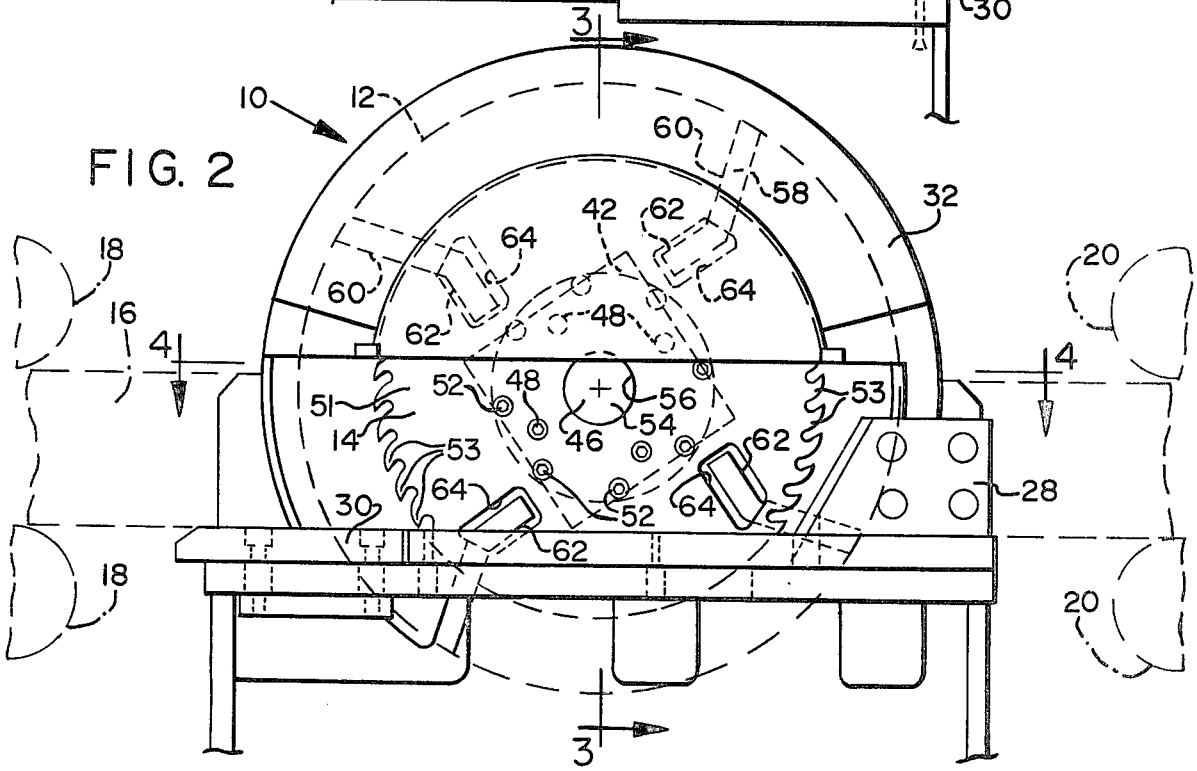
FIG. 2 is a front view, at a larger scale, of the circular saw and rotary chipper head combination shown in FIG. 1.

Referring now also to FIGS. 2 and 3, wherein the chipper head 12 the and circular saw blade 14 may be seen in greater detail, the apparatus 10 of the invention is seen to comprise a mandrel 34 including a shaft 36 supported in bearings 38 and having a tapered arbor 40 upon which square hub 42 is mounted. Each of four knife holders 44 is fixedly attached to one of the four sides of the square hub 42, and an adapter faceplate 46 is attached by bolts 48 to the end 50 of the square hub 42.

The circular saw blade 14 comprises a unitary circular plate 51 having a plurality of saw teeth 53 spaced about its entire periphery, and is attached to the adapter faceplate 46 by screws 52. To resist wear, the teeth 53 may include cutting edges of carbide or other wear-resistant material (not shown). A circular projection 54 located centrally on the adapter faceplate 46 projects into a circular aperture 56 located in the center of the circular plate 51 to accurately center and support the circular saw blade 14 with respect to the chipper head 12.

A bent chipper knife 58 is mounted in each knife holder 44 and includes an obliquely angled sharpened chipping edge 60 and an adjacent radially extending sharpened facing edge 62. Four apertures 64 in the circular saw blade 14 receive portions of the chipper knives 58, which extend therein approximately 1/16 inch beyond the near side 66 of the circular saw plate 51. The facing edges 62 are consequently located entirely within the apertures 64.

Since the chipper knives 58 are spaced radially inwardly from the saw teeth 53, the saw plate 51 may be of one piece construction, and the spacing, or pitch, of the saw teeth may be as close as desired and may be uniform around the complete periphery of the saw plate 51. For example, a circular saw blade 14 with a 16 inch diameter and a ¼ inch plate thickness (from side 66 to side 68) may have 36 or more teeth spaced uniformly about its periphery, making the cut of each tooth relatively small compared to the cut of each chipper knife.

Referring now particularly to FIG. 4, showing the chipper head 12 and circular saw blade 14 of the surfacing apparatus 10 of the present invention in top view, it may be seen that the anvil 30 is located close to the conical path of rotation 71, indicated in broken line, of each chipping edge 60 (FIG. 3), and that the anvil 30 is cut away to provide room for rotation of the circular saw blade 14, which projects radially a predetermined radial projection distance 72 beyond the chipping edges 60. Because of this projection of the circular saw blade 14, the circular saw blade 14 cuts a kerf in a workpiece before the chipping edges 60 cut into the material which is being removed from the workpiece.

The radial projection distance 72 is sufficient to permit the saw blade 14 to cut through knots and other irregular portions of a workpiece before the chipping edges 60 cut that portion of the material of the workpiece. Sawing the unwanted portions of such irregular material from the workpiece keeps them from being torn away from the workpiece by the chipping edges 60 to result in imperfections of the surface of the workpiece.

Because of the typical characteristics of different types of wood, the radial projection distance 72 by which the circular saw radius should exceed the radius at which the facing edge 62 intersects the chipper edge 60 depends on the wood to be surfaced. For instance, for knotty pine wood the radial projection distance 72 should be greater than that necessary for relatively knot-free and tight-grained wood such as fir. For example, with a circular saw blade 14 which is 16 inches in diameter, a radial projection distance 72 of $1\frac{1}{8}$ inches has been found to be satisfactory for surfacing pine wood, and in any case the radial projection distance 72 should be at least $\frac{1}{2}$ inch.

Referring now to FIG. 5, each aperture 64 may be seen to closely surround the facing edge 62 of the respective chipper knife 58. It has been found that with a space of $\frac{1}{8}$ inch between the facing edge 62 and the interior surface 74 of the aperture 64, there is no problem of sawdust and chips being trapped between the chipper knife 58 and the saw blade 14.

In FIGS. 6 and 7 it may be seen that the facing edge 62 extends parallel to the sides 66 and 68 of the saw plate 51 and is located about $\frac{1}{4}$ of the distance through the saw plate 51 from the near side 66 toward the workpiece side 68 or about $\frac{2}{3}$ of the kerf width 75 from the finished surface of the workpiece. The distance 76 by which the facing edge 62 is spaced inwardly of the near side 66 of the saw plate 51 allows the saw plate 51 to flex slightly during operation without the facing edge 62 having to actually cut against the face of the workpiece. The clearance within the aperture 64 similarly allows some relative motion between the saw plate 51 and the chipper knives 58 without damage to the saw blade 14 or the chipper knives 58. The facing edges 62 and the knife holders 44 meet the saw plate 51 at an acute angle, so that chips of wood and sawdust are deflected away from the circular saw blade 14 by the trailing portions of the chipper knives 58 and the knife holders 44.

While the embodiment shown and described above is preferred, in an alternative embodiment of the invention (not shown) the apertures 64 could be extended to the periphery of the saw blade 14, preserving the unitary saw plate construction and resulting ease of saw blade alignment with respect to the chipper head 12.

In operation, the surfacing apparatus 10 of the invention is rotated by means of the shaft 36. A workpiece, such as the cant 16, is fed toward the circular saw blade 14, as indicated by the arrow 78, by the infeed rollers 18. The side roller 22 holds the cant 16 tightly against the guide rail 26, as the circular saw blade 14, rotating in the direction indicated by the arrows 80, cuts the cant 16 to leave a smooth surface the desired distance away from the guide rail 26. Since the saw teeth 53 are spaced closer together than the chipper knives 58, the saw teeth cut more smoothly and with less vibration than is possible using a chipper head alone.

The anvil 30 supports the portion of the cant 16 which is cut away by the circular saw blade 14, as the chipping edges 60 of the chipper knives 58 chip that portion of the wood. The outboard guide shoe 28 supports the newly cut surface of the cant 16, helping to hold the cant 16 against the guide rail 26, and the outfeed rollers 20 pull the cant from the surfacing apparatus. Because of a smaller amount of vibration imparted to the workpiece the apparatus of the invention forms a smooth surface closer to the trailing end of the workpiece than has previously been possible. Sawing through knots and areas of crooked grain also reduces the amount of work which must be rejected.

Although in the embodiment of the invention shown there are four chipper knives 58 in the chipper head 12, it is obvious that the invention would be applicable to chipper heads having fewer or more chipper knives 58, by using a corresponding number of apertures 64 in a circular saw blade 14. Since the size of chips produced is determined by the combined effects of the rotational speed of the chipper head 12, the number of chipper knives 58, and the linear speed at which a workpiece is fed past the surfacing apparatus 10, smaller chips will be produced by a chipper head 12 having more chipper knives 58 if the other factors remain the same, and the number of chipper knives 58 is a matter of choice depending on the size of chips desired.

Although the apparatus shown and described herein is adapted to edging a sawn cant 16, it will be apparent that by the use of other feed apparatus the surfacing apparatus 10 of the present invention could be used equally well for forming a flat surface on a log or other irregularly shaped workpiece.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for forming a flat surface on a workpiece, comprising:

(a) a rotatable mandrel;

(b) a unitary saw plate mounted for rotation with said mandrel, said saw plate having a generally circular periphery, a near side and a workpiece side;

(c) a plurality of saw tooth means arranged about said periphery of said saw plate for cutting away portions of said workpiece to form said flat surface perpendicular to the axis of rotation of said mandrel, said saw tooth means defining a kerf;

(d) means for defining a plurality of apertures extending through said saw plate; and (e) a plurality of chipper knives mounted for rotation with said mandrel, each of said plurality of chipper knives having a cutting edge extending within a respective one of said apertures and terminating short of said workpiece side of said saw plate.

2. The apparatus of claim 1 wherein said apertures are completely enclosed openings extending through said saw plate at locations spaced radially inward from said saw tooth means.

3. The apparatus of claim 1 wherein said saw tooth means are equally spaced from one another about the periphery of said unitary circular saw plate.

4. The apparatus of claim 1, wherein said saw tooth means are set to define a kerf wider than the thickness of said saw plate, said cutting edges terminating within said kerf approximately ⅓ of the distance from said near side to said workpiece side of said kerf.

5. The apparatus of claim 1 wherein said circular saw blade has a plate thickness, each of said chipping edges extending into a respective one of said plurality of apertures a distance equal to about ¼ of said plate thickness.

6. The apparatus of claim 1 wherein each said chipper knife includes a chipping edge extending away from said saw plate at an acute angle with respect to the portion of said saw plate located radially outward from the respective aperture associated with each said chipper knife.

7. The apparatus of claim 1 wherein each of said chipper knives includes a chipping edge portion extending from within said respective aperture away from said saw plate in the direction of said near side, said knife extending to a radius greater than the radius of said saw plate.

8. The apparatus of claim 1 wherein said saw plate is generally planar and each of said chipper knives includes a facing edge portion disposed entirely within a respective one of said apertures and oriented generally parallel with the plane of said saw plate.

9. The apparatus of claim 1 including a hub attached to said mandrel, said apparatus further including a knife holder means for mounting each of said chipper knives on said hub and attachment means for attaching said circular saw plate to said hub.

10. The apparatus of claim 9 wherein said attachment means includes a faceplate connected to said hub, said faceplate having a central projection and said saw plate including a central aperture, said central projection and said central aperture fitting matingly together to locate said saw plate with respect to said mandrel.

11. The apparatus of claim 1 wherein said saw tooth means are spaced radially outward from said apertures by a radial projection distance, said radial projection distance being at least ½ inch.

* * * * *